US005134419A

United States Patent [19]

Egashira

[11] Patent Number: 5,134,419

[45] Date of Patent: Jul. 28, 1992

[54] THREE-WAVE SHARED ANTENNA (RADIO, AM, AND FM) FOR AUTOMOBILE

[75] Inventor: Yoshimi Egashira, Tokyo, Japan

[73] Assignee: Harada Industry Co., Ltd., Tokyo, Japan

[21] Appl. No.: 612,838

[22] Filed: Nov. 9, 1990

[30] Foreign Application Priority Data

Nov. 17, 1989 [JP] Japan ..... 1-298946

[51] Int. Cl.[5] ..... H01Q 1/00

[52] U.S. Cl. ..... 343/722; 343/715; 343/901

[58] Field of Search ..... 343/715, 900, 901, 903, 343/722, 749, 750, 751, 752

[56] References Cited

U.S. PATENT DOCUMENTS

| | | | |
|---|---|---|---|
| 4,095,229 | 6/1978 | Elliott | 343/715 |
| 4,675,687 | 6/1987 | Elliott | 343/722 |
| 4,721,965 | 1/1988 | Elliott | 343/715 |
| 4,734,703 | 3/1988 | Nakase et al. | 343/790 |
| 5,017,935 | 5/1991 | Hayashi et al. | 343/722 |

FOREIGN PATENT DOCUMENTS

| | | |
|---|---|---|
| 0350308 | 1/1990 | European Pat. Off. . |
| 3833288 | 7/1989 | Fed. Rep. of Germany . |
| 2185635 | 7/1987 | United Kingdom . |

*Primary Examiner*—Michael C. Wimer

*Assistant Examiner*—Hoanganh Le

*Attorney, Agent, or Firm*—Frishauf, Holtz, Goodman & Woodward

[57] ABSTRACT

A three-wave shared antenna used in an automobile comprises an MT wave element 10A wherein first and second phasing coils 11 and 12 are formed in an intermediate position of a conductive mast thereby forming the MT wave element 10A is formed in a three-step collinear manner to be able to transmit/receive an MT wave, a trap element 10B for interrupting the MT wave formed on top portion of the MT wave element 10A, and an auxiliary element 10C for AM and FM waves, which comprises another conductive mast connected to said conductive mast through the trap element 10B to be able to receive AM wave, which is a broadcast wave of an amplitude modulation system and FM wave, which is a broadcast wave of a frequency modulation system, in cooperation with said MT wave element. Then, the electrical length of said auxiliary element 10C for AM and FM waves is set to ($\frac{3}{4}$) wavelength of the electrical wave of the frequency close to the frequency of the transmission side in a radio telephone band, and the electrical length of said MT wave element 10A is set to an electrical length in which the sum L of the length of said MT wave element 10A and that of said auxiliary element 10C for AM and FM waves adjusts to the reception of the FM wave.

2 Claims, 5 Drawing Sheets

THREE-WAVE SHARED ANTENNA (RADIO, AM, AND FM) FOR AUTOMOBILE

BACKGROUND OF THE INVENTION

1. Field of the Invention

The present invention related to a three-wave shared antenna of a rod type used in an automobile wherein the three-wave shared antenna can transmit/receive a radio mobile telephone wave (hereinafter called an MT wave), and receive a broadcast wave of an amplitude modulation system (hereinafter called an AM wave) and a broadcast wave of a frequency modulation system (hereinafter called an FM wave).

2. Description of the Related Art

Conventionally, there was provided this type of a three-wave shared antenna comprising an MT wave element formed in a two-step collinear manner wherein a phasing coil is provided in an intermediate portion of a rod-type element and an electrical wave length is $(\frac{3}{8})\lambda+(\frac{5}{8})\lambda$ to adjust to the MT wave. By the use of this type of the antenna, transmission/reception of the MT wave can be performed with high sensitivity. However, since the length of the element is too short, the sensitivity of transmission/reception of the AM or FM wave is poor. In other words, it is normally necessary for the antenna element for the AM wave or FM wave to have its length of about 0.75 to 0.95 m. Therefore, the length of the above-mentioned three-wave shared antenna is 0.35 to 0.4 m and is too short as compared with the normal length of the antenna. Due to this, lack of sensitivity occurs. In general, in order to eliminate the above disadvantage, impedance of a feeder cable is made lower, and the FM wave is amplified by a booster, thereby compensating lack of sensitivity. However, since an active element is used to improve sensitivity of FM wave in the above-mentioned antenna using the booster, there is a limitation in its amplification degree. Therefore, if the amplification exceeds its limitation, there occur troubles in such as a cross modulation or an intermodulation. In addition, there are problems in that increment of station to station noise occurring in a space region between a certain station to a next station, and decrement of S/N ratio.

Recently, three-wave shared antennas, which are contrived not to generate the above-mentioned problems, have been developed. In these improved antennas, a conductive mast is connected to the top portion of an MT wave element, which is formed in a two-step collinear manner for the above-mentioned MT wave, through a trap element. The trap element comprises an inductance element and a capacitance element, which are connected in parallel to each other. AM and FM waves are allowed to pass through the trap element, but the trap element has an MT wave interruption function by which MT wave is prohibited from passing through the trap element by generating parallel resonance. The conductive mast is arranged to generate resonance of a $\frac{1}{4}$ wavelength in the FM wave and be able to receive the AM wave.

The above-structured antenna operates in the two-step collinear manner in the transmission/reception of the MT wave. In the reception of the FM and AM waves, the entire length of the antenna element is used as an antenna function. Therefore, according to the above-structured antenna, not only the transmission/-reception of the MT wave but also the reception of the FM and AM waves can be performed with relatively high sensitivity. However, it cannot be said that the above-structured antenna has a satisfactory characteristic. Particularly, since the length of the antenna element is short, a focusing point level of a gain characteristic against the electric filed strength of the antenna cannot be improved. As a result, S/N ratio of FM wave and that of AM wave are low.

Additionally, in an automobile antenna, it is required that the antenna is fixed to a car body to be slightly inclined backward in terms of the design and the object wherein aerodynamic noise resulting from the reception of wind pressure is reduced. However, since the above-mentioned three-wave shared antenna comprises an MT wave element having strong directivity, sensitivity of the transmission/reception of MT wave is abruptly lowered if the antenna is fixed to the car body to be slightly inclined backward.

As mentioned above, in the three-wave shared antenna wherein the conductive mast, which is used for receiving AM and FM waves, is connected to the top end portion of the MT wave element formed in the two-step collinear manner through the trap element, there is not provided the necessary and sufficient antenna characteristics. It can be considered that the antenna characteristic can be improved by making the length of the conductive mast to be connected to the top end portion of the MT wave element sufficiently larger. However, the conductive mast has its limit in that its length is made larger as explained later. Due to this, the antenna characteristic cannot be improved by making the length of the conductive mast longer.

More specifically, logically speaking, the length of the conductive mast may be set to an odd-numbered multiple of $(\frac{1}{4})\lambda$ when the wavelength of the electric wave having a frequency of the radio telephone band is $\lambda$. However, in actuality, this is limited to about five time. In other words, if the length of the conductive mast is set to much larger (for example, about seven times, or nine times), a radiation pattern is disordered when the transmission/reception of the wave is performed in the radio telephone band, so that various troubles occur. Moreover, such conductive mast is limited in the manufacture and the structure. For example, in order to contain the antenna in the car body, it is necessary to limit the length of the lower portion, which is lower than the feeding portion of the antenna, so as to adjust to the inner space of the car body. In consideration of the above-mentioned point, the length of the conductive mast is limited to about three times of $(\frac{1}{4})\lambda$. Therefore, the entire length of the above-structured antenna is about 0.5 to 0.6 m.

As compared the above-mentioned antenna with the antenna, which is used for AM and FM waves, having the length of 0.75 to 0.95 m, lack of sensitivity cannot be avoided. Moreover, a good S/N ratio cannot be obtained.

On the other hand, if the above-mentioned three-wave shared antenna is fixed to be slightly inclined to the back of the automobile, there is a case that the sensitivity of the transmission/reception of MT wave is abruptly lowered. Therefore, the antenna was not able to be fixed to the car body to be inclined backward.

SUMMARY OF THE INVENTION

A first object of the present invention is to provide a three-wave shared antenna used in an automobile wherein the three-wave shared antenna can transmit/- receive a radio mobile telephone wave, that is, an MT wave, and receive broadcast waves, that is, an AM wave and an FM wave with the same sensitivity as that of the antenna having the length of 0.75 to 0.95 m without deteriorating a cross modulation, an intermodulation, and an S/N ratio.

In addition to the first object, a second object of the present invention is to provide a three-wave shared antenna, wherein sensitivity of the transmission/reception of MT wave is little lowered even if an antenna can be fixed to a car body to be slightly inclined backward (for example, about 10° to 20°), thereby the antenna can be fixed to the car body to be inclined to have a favorable design and reduce aerodynamic noise.

In addition to the second object, a third object of the present invention is to provide a three-wave shared antenna wherein the antenna can be fixed to an antenna hole, which is formed on the wall of a car body and has a standardized diameter, without providing any special treatments, and an antenna element is contacted, thereby such an antenna can be contained in an inner car body, which is relatively small, without any troubles.

In order to solve the above-mentioned subject matter and attain the objects, the present invention has provided the following means:

(1) A three wave shared antenna used in an automobile wherein the three-wave shared antenna can receive/transmit a radio mobile telephone wave, that is, an MT wave, and receive broadcast waves, that is, an AM wave and an FM, comprising:

an MT wave element wherein first and second phasing coils are formed in an intermediate position of a conductive mast thereby forming the MT wave element is formed in a three-step collinear manner to be able to transmit/receive an MT wave; a trap element for interrupting the MT wave formed on top portion of the MT wave element; and an auxiliary element for AM and FM waves comprising another conductive mast connected to the conductive mast through the trap element to be able to receive AM and FM wave in cooperation with the MT wave element; wherein the electrical length of the auxiliary element for AM and FM waves is set to ($\frac{3}{4}$) wavelength of the electrical wave of the frequency close to the frequency of the transmission side in a radio telephone band, and the electrical length of the MT wave element is set to an electrical length in which the sum of the length of the MT wave element and that of the auxiliary element for AM and FM waves adjusts to the reception of the FM wave.

(2) where the wavelength of the electrical wave of the frequency, which is close to the frequency of the transmission side in the radio telephone band is $\lambda$, the MT wave element comprises a first element projecting a wall of a car body and comprising a conductive mast whose electrical length is ($\frac{3}{8}$)$\lambda$; a second element forming on top portion of the first element and comprising a first phasing coil whose electrical length is ($\frac{1}{4}$)$\lambda$, a third element forming on top portion of the second element and comprising a conductive mast whose electrical length is ($\frac{3}{4}$), a fourth element forming on top portion of the third element and comprising a second phasing coil whose electrical length is ($\frac{1}{4}$)$\lambda$, and a fifth element forming on top portion of the fourth element and comprising a helical coil whose electrical length is ($\frac{5}{8}$ to $\frac{3}{4}$)$\lambda$.

(3) conductive pipes having different diameters are slidably connected to each other, thereby forming the freely extendible third element, the conductive pipe having the largest diameter in the third element is coupled to the top portion of the second element; a wire is wound around the outer periphery of a cylindrical insulating material with a different pitch in accordance with the function of respective elements, thereby the fourth element comprising the second phasing coil, the fifth element comprising the helical coil, and a sixth element comprising a trap element are integrally formed and detachably inserted into the first to the third elements; and the conductive mast, which is the auxiliary element for the AM and FM waves, wherein the electrical length of said auxiliary element for AM and FM waves is set to ($\frac{3}{4}$) wavelength of the electrical wave of the frequency close to the frequency of the transmission side in the radio telephone band, is detachably inserted into the cylindrical insulting material in the fourth to sixth materials.

As a result of the use of means described in above item (1), the following operation can be performed:

The MT wave element is formed of a conductive mast having predetermined electrical length wherein first and second phasing coils are provided in the intermediate position to cancel a negative phase. Then, the MT wave element is used as an antenna of a three-step collinear system. Therefore, the transmission/reception of the MT wave, which is the electric wave used for the radio telephone, can be performed well.

Also, the electrical length of the auxiliary element for AM and FM waves is set to ($\frac{3}{4}$) wavelength and the sum of the length of the MT wave element and that of the auxiliary element for AM and FM waves adjusts to the reception of the FM wave. Additionally, the first and second phasing coils work as a loading coil, which cancels capacitive of the antenna in relation to the FM wave and presents a resonant state. Also, no booster is used at all. As a result, the broadcast waves, that is, an AM wave and an FM wave can be received with the same sensitivity as that of the antenna having the length of 0.75 to 0.95 m without deteriorating a cross modulation, an intermodulation, and an S/N ratio.

As a result of the use of means described in above item (2), the following operation can be performed:

The electrical length of the first to fifth elements forming the MT wave element is set to be slightly shifted than an ideal value, thereby the cancellation of the negative phase due to the first and second phasing coils cannot be completely performed. According to the operation of the residual negative phase, a half power angle (the strength of the directivity of the antenna, that is, an angle from the direction where the directivity is maximum (maximum power) to the direction where the power is reduced to a half) in the vertical surface pattern extends. As a result, even if the antenna is fixed to the car body to be slightly inclined toward the surface of the car body (for example, 10° to 20°), the sensitivity of the transmission/reception of the MT wave is little lowered. The gain is slightly reduced by the inclination of the antenna. However, the use of the three-step collinear system fully compensates for the reduction of the gain. For the above reason, the antenna can be fixed to the car body to be inclined backward in a state wherein the antenna characteristic is not deteriorated and a favorable design is kept, and aerodynamic noise can be reduced.

As a result of the use of means described in above item (3), the following operation can be performed:

Structurally speaking, this element is the same as a telescope-typed element in such a manner that pipes having five different diameters are connected to each other. According to this, the maximum diameter of the antenna element is the same as the ordinary antenna for the AM and FM waves. Therefore, the antenna can be fixed to the car body without providing any special treatments in the antenna hole having a standardized diameter formed on the wall of the car body. Moreover, since the electrical length of the conductive mast, which is the auxiliary element for the AM and FM waves and which determines the portion (so-called an under head size) where the antenna is contained in the car body, is set close to ($\frac{3}{4}$) wavelength, the under head size can be contained within the range of the standardized size. As a result, the antenna element can be contracted and contained in even a relatively small car body without any troubles.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIG. 1 is a side view showing a schematic structure of the entire antenna;

FIG. 2 is a view showing a circuit structure of an electric system of the antenna of FIG. 1;

FIGS. 3 and 4 are partially cutaway side views showing a specific structure of an antenna element portion of a three-wave shared antenna; and FIG. 5 is a view explaining the operation.

DETAILED DESCRIPTION OF THE PREFERRED EMBODIMENTS

Figure 1:
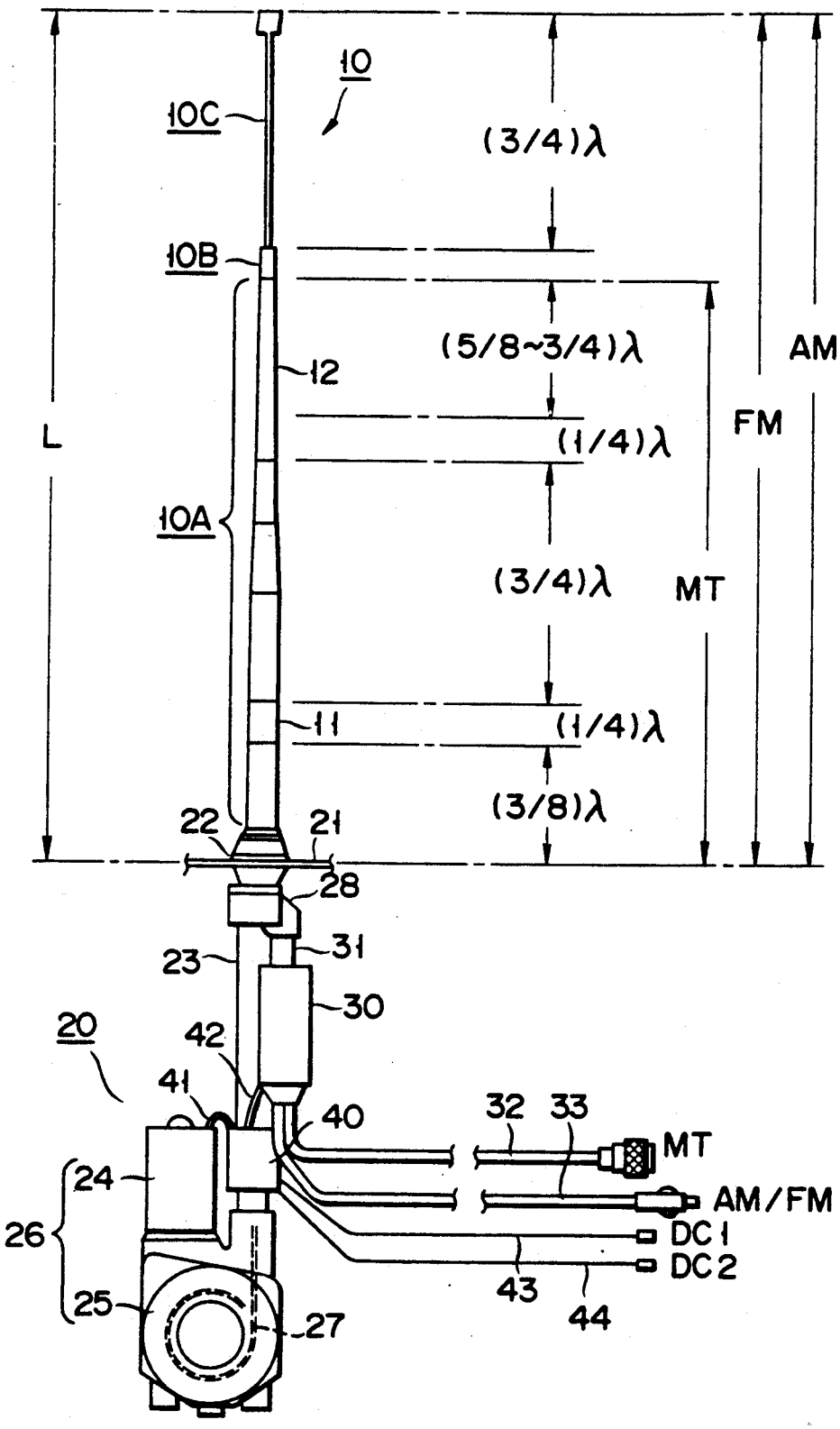
FIGS. 1 to 5 are views showing one embodiment of the present invention.

FIG. 1 is a side view showing a schematic structure of one embodiment of the present invention. Reference numeral 10 denotes a three-wave shared antenna element which can transmit/receive a MT wave and receive FM and AM waves.

The three-wave shared antenna element 10 comprises three parts, that is, an MT wave element 10A, a trap element 10B for interrupting the MT wave, and an auxiliary element 10C for AM and FM waves.

In order to transmit/receive the MT wave, the MT wave element 10A is formed in a three-step collinear manner by providing first and second phasing coils 11 and 12, in which a lead wire is wound, in an intermediate position of a conductive mast (to be explained later) structured in a multi-step manner.

The trap element 10B is provided in the upper end portion of the MT wave element 10A. AM and FM waves are allowed to pass through the trap element 10B, but the trap element has an MT wave interruption function by which MT wave is prohibited from passing through the trap element 10B by generating parallel resonance.

The auxiliary element 10C for AM and FM waves comprises another conductive mast connected to the conductive mast of the MT wave element 10A through the trap element 10B. The auxiliary element 10C is provided to receive AM and FM wave in cooperation with the MT wave element 1OA.

The electrical length of the auxiliary element 10 for AM and FM waves is set to be close to ($\frac{3}{4}$)$\lambda$ when the wavelength of the electrical wave having the frequency close to the frequency in the transmission side in the radio telephone band is $\lambda$. Also, the electrical length of the MT wave element 10A is set to the value in which the sum L of the length of the MT wave element 10A and that of the auxiliary element 10C for AM and FM waves adjusts to the reception of FM wave. The value of the electrical length of the respective parts is explained later.

Reference numeral 20 is an antenna element extendible drive mechanism. The drive mechanism 20 comprises an element containing cylinder 23, a rope transfer mechanism 26, and a flexible rope 27. A neck mold portion 22 is fixed to a car body wall 21, thereby the element containing cylinder 23 is fixed thereto. The element containing cylinder 23 is formed so that the antenna element 10 can be detachably contained in the interior of the cylinder. The rope transfer mechanism 26 comprises a motor 24 and a rotation drum 25, and is fixed to the lower end portion of the element containing cylinder 23. In the flexible rope 27 with a rack, its one end portion is connected to the base end portion of the conductive mast of the auxiliary element 10C for AM and FM waves, and its other end is wound around the rotation portion of the drum 25.

Then, the flexible rope 27 for an extendible operation is transferred in the longitudinal direction by the rope transfer mechanism 26, thereby the conductive mast of the auxiliary element 10C for AM and FM waves. As a result, the other portions work in cooperation with the conductive mast and the extendible operation of the antenna element is performed. Additionally, when the antenna element 10 contracts, the auxiliary element 10C is inserted into the trap element 10B, the trap element 10B is inserted into the MT wave element 10A, and the the MT wave element 10A is inserted into the element containing cylinder 23.

In FIG. 1, reference numeral 28 is a feeding section, which is provided in the upper end portion of the element containing cylinder 23. Reference numeral 30 is a feeding box containing a splitter. One end of the feeding box 30 is connected to the feeding section 28 via a short coaxial cable 31. Each end of a cable 32 for MT wave and a cable 33 for AM and FM waves is connected to the other end of the feeding box 30. Reference numeral 40 is a relay box containing a relay for switching a normal/reverse rotation of the motor 24. One end of the relay box is connected to the motor 24 and the feeding box 30 via lead wires 41 and 42. Power supply lines 43 and 44 are connected to the other end of the relay box 40.

Figure 2:
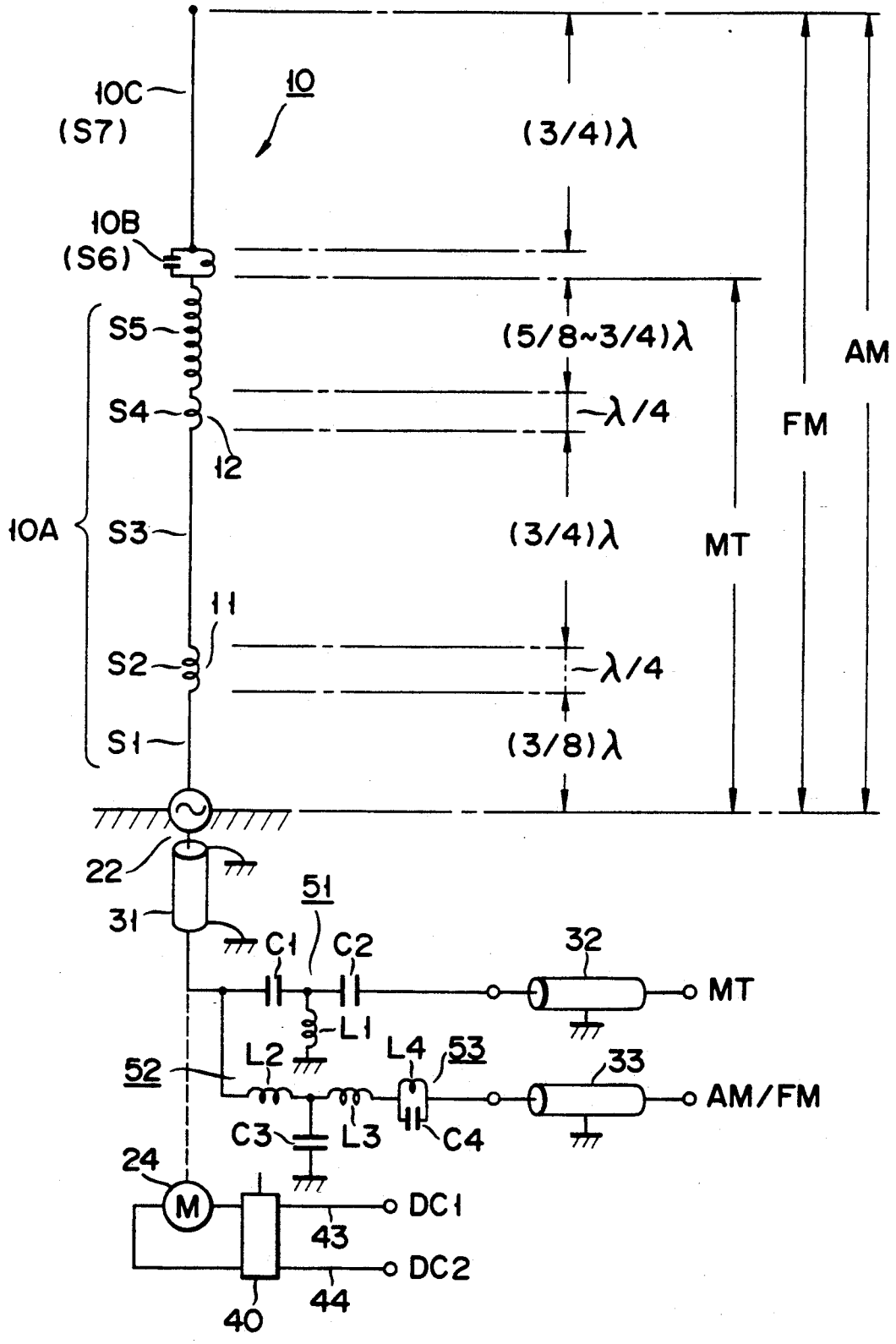

FIG. 2 is a view showing a circuit structure of an electrical system of the three wave shared antenna of the embodiment of the present invention.

As shown in FIG. 2, the electrical length of the respective parts of the MT wave element 10A is set as follows:

Where the wavelength of the electric wave with a frequency (for example, 840 MHz), which is close to the frequency of the transmission side in the radio telephone band, is set to λ, a first element S1, which comprises a conductive mast projecting from the car body wall, is set to have an electrical length of (⅜)λ. A second element S2, which comprises a first phasing coil 11 formed on top portion of the first element S1, is set to have an electrical length of (¼)λ. A third element S3, which comprises the conductive mast formed on top portion of the second element S2, is set to have an electrical length of (¾)λ. A fourth element S4, which comprises a second phasing coil 12 formed on top portion of the third element S3, is set to have an electrical length of (¼)λ. A fifth element S5, which comprises a helical coil formed on top portion of the fourth element S1, is set to have an electrical length of (⅝ to ¾)λ.

A stray capacity of the neck mold portion 22 is made smaller by the well-known means. The coaxial cable 31 has a predetermined electrical length in order to obtain a wide band.

The MT wave signal passes through the coaxial cable 31, a high pass filter 51, which comprises C1, C2, L1, and the cable 32 for MT wave. The terminal of the cable 32 is connected to a radio telephone set (not shown). AM and FM wave signals pass through a low pass filter 52, which comprises L2, L3, and C3, and further pass through a trip circuit 53, which comprises L4, C4, for prohibiting MT wave, thereafter these signals pass through the cable 33 for AM and FM waves. The terminal of the cable for AM and FM waves is connected to a radio receiver (not shown).

Power is supplied to the motor 24 from the power supply lines 43 and 44 via the relay in the relay box 40.

Figure 3:
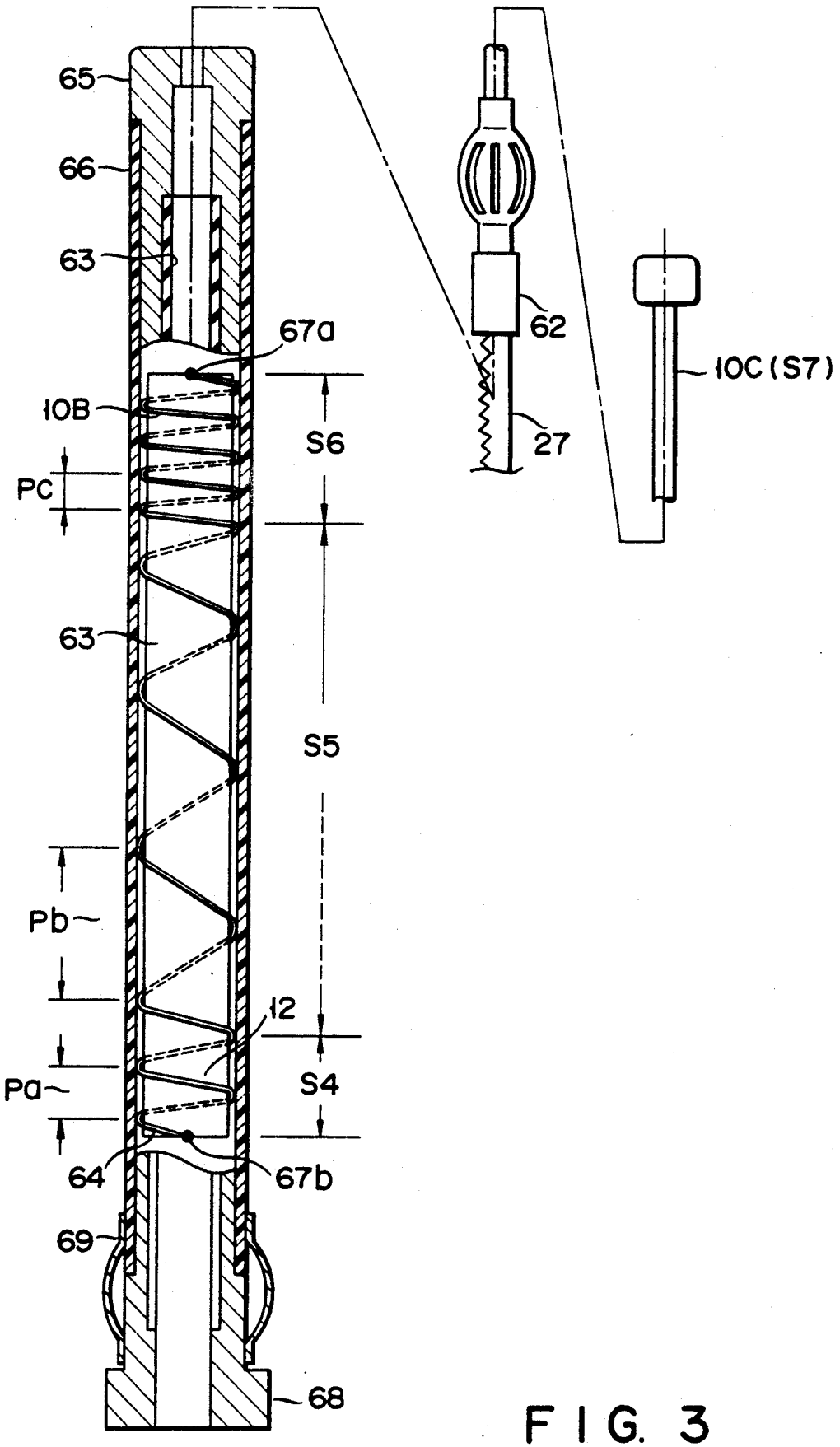
Figure 4:
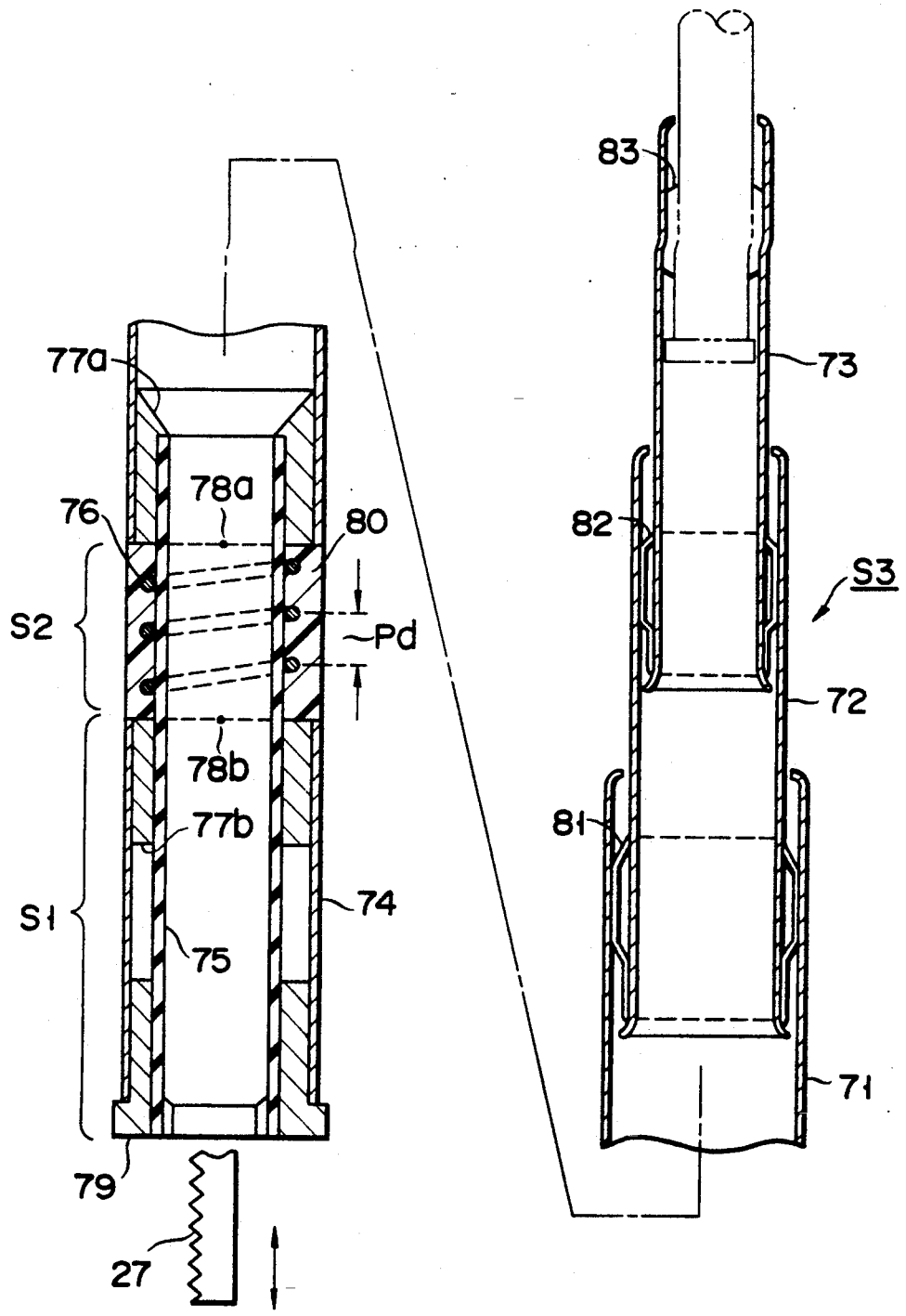

FIGS. 3 and 4 are partially cutaway side views showing a specific structure of an antenna element portion of a three-wave shared antenna according to the embodiment of the present invention.

As shown in FIG. 3, the conductive mast, which is the auxiliary element 10C for AM and FM waves whose electrical wave length is set to be close to (¾)λ, is formed to be detachably inserted into the cylinder in which the fourth element S4, the fifth element S5, the sixth S6 comprising the trap element **10*b* are integrally formed as explained later. One end portion of the flexible rope 27 with a rack for extendible operation of the antenna element is connected to the lower end portion of the auxiliary element 10C for AM and FM waves via a joint 62**.

The fourth element S4 comprising the second phasing coil 12, the fifth element S5 comprising the helical coil and the sixth element S6 comprising a trap element 10B are integrally formed by winding a wire 64 around the outer periphery of a cylindrical insulating material 63 with different pitches Pa, Pb, and Pc in accordance with the function of the respective elements. This integrated element is coupled to be detachably inserted into the first element S1 to the third element S3 as explained later.

To obtain the fourth element S4, the wire 64 is wound in order that the extend length of the wire 64 corresponds to electrical length of (¼)λ. Also, the wire 64 is wound in a state wherein pitch Pa is made as small as possible within a range wherein the parallel resonance is not generated in the line to line stray capacity.

To obtain the fifth element S5, the wire 64 is wound in a state wherein pitch Pb is made as large as possible in order that the extend length of the wire 64 corresponds to electrical length of (⅝ to ¾)λ.

To obtain the sixth element S6, the wire 64 is wound in a state wherein pitch Pc is constant in order to generate the parallel resonance against the frequency in the radio telephone band based on the relation between the line to line stray capacity.

In FIG. 3, reference numeral 65 is an upper conductor, 66 is an insulation cover, **67*a* and 67*b* are contact points of a wire, 68 is a lower conductor, and 69** is a contact spring.

As shown in in FIG. 4, the third element S3 is a freely extendible element wherein conductive pipes 71, 72 and 73 having different diameters are slidably connected to each other in a telescope type. In the third element S3, the lower end of the conductive pipe 71 having the largest diameter is coupled to the top portion of the second element S2 formed on the first element S1.

The first element S1 is formed by that a metallic outer cylinder 74 is coaxially connected to the outside of a reinforced plastic insulation cylinder 75.

The second element S2 is formed by that a wire 76 is wound around the outside of the reinforced plastic insulation cylinder 75 with a predetermined pitch. The surrounding of the wire 76 is hardened by an insulating member 80 such as synthetic resin. The wire 76 is wound in a state wherein pitch Pd is made as small as possible within a range wherein the parallel resonance is not generated in the line to line stray capacity, in order that the extend length of the wire 76 corresponds to electrical length of (¼)λ. Both ends of the wound wire 76 are connected to metallic joints **77*a* and 77*b* at contact points 78*a* and 78*b*. The joint 77*a* is connected to the conductive pipe 71 and the joint 77*b* is connected to the metallic outer cylinder 74. In FIG. 4, a reference numeral 79 is a stopper for preventing the entire element from being detached from the containing cylinder 23. Also, reference numerals 81 to 83 are contact springs in order to improve an electrical conductivity between conductive pipes 71 to 73 and between pipes 71, 73** and other other elements.

According to the above-structure embodiment of the present invention, the following effect can be exerted:

The MT wave element is formed of a conductive mast having a predetermined electrical length wherein first and second phasing coils are provided in the intermediate position to cancel a negative phase (reverse phase). Then, the MT wave element is used as an antenna of a three-step collinear system. Therefore, the transmission/reception of the MT wave, which is used for the radio telephone, can be performed well.

Also, the electrical length of the auxiliary element 10C for AM and FM waves is set close to (¾)λ. Then, the electrical length of the MT wave element is set to obtain an electrical length in which the sum L of the length of the MT wave element 10A and that of the auxiliary element 10C for AM and FM waves adjusts to the reception of the FM wave.

The specific example is shown as follows:

If the frequency of MT wave is 840 MHz, its (¼)λ becomes about 90 mm. In view of the structure, the necessary physical lengths of the first and second phasing coils 11 and 12 are 30 mm, respectively. Here, the auxiliary element 10C for the AM and FM waves is used as the seventh element S7. Regarding the ideal values M1 to M7, that is, ideal lengths thereby the maximum gain can be obtained in frequency of 840 MHz, of the respective lengths of the first element S1 to the seventh element S7, the following shows the experimental values N1 to N7 in the embodiment of the present invention wherein the electrical length is set as mentioned above:

| | | | |
|---|---|---|---|
| M1 | 90 × 1 mm | N1 | 135 mm |
| M2 | 30 × 1 mm | N2 | 30 × 1 mm |
| M3 | 90 × 2 mm | N3 | 270 mm |
| M4 | 30 × 1 mm | N4 | 30 × 1 mm |
| M5 | 90 × 2 mm | N5 | 225 mm |
| M6 | 30 × 1 mm | N6 | 30 × 1 mm |
| M7 | 90 × 3 mm | N7 | 270 mm |

As a result, the total of the experimental values N1 to N7 is 990 mm, and sufficiently longer than the total of the ideal values of 810 mm. Additionally, in actual, the total length of 990 mm is multiplied by a shortening rate. Moreover, the fifth element S5 is made helical in order to place the under head size of the antenna within an allowable range. For these reasons, the entire length of the antenna can be made closer to the length of 720 to 760 mm.

Additionally, the first and second phasing coils 11 and 12 and the helical coil, which forms of the fifth element S5, work as a loading coil, which cancels capacitive of the antenna against the FM wave and presents a resonant state. Also, there is an operation wherein effective length can be enhanced against the AM wave. In the above embodiment, no booster is used at all.

Therefore, the broadcast waves, that is, an AM wave and an FM wave can be received with the same sensitivity as the antenna having the length of 0.75 to 0.95 m without deteriorating a cross modulation, an intermodulation, and an S/N ratio. The respective electrical lengths of the first element S1 to the fifth element S5, which form the MT wave element 10A, are set to the values which are slightly shifted than the ideal values.

More specifically, regarding the ideal values V1 to V5 (the ideal electrical lengths wherein the maximum gain can be obtained) of the respective electrical lengths of the elements S1 to S5, the following shows the experimental values W1 to W5 in the embodiment of the present invention:

| | | | |
|---|---|---|---|
| V1 | $(\frac{1}{4})\lambda$ | W1 | $(3/8)\lambda$ |
| V2 | $(\frac{1}{4})\lambda$ | W2 | $(\frac{1}{4})\lambda$ |
| V3 | $(\frac{1}{4})\lambda$ | W3 | $(\frac{3}{8})\lambda$ |
| V4 | $(\frac{1}{4})\lambda$ | W4 | $(\frac{1}{4})\lambda$ |
| V5 | $(\frac{1}{4})\lambda$ | W5 | $(5/8)\lambda$ to $\frac{3}{8}\lambda$ |

Figure 5:
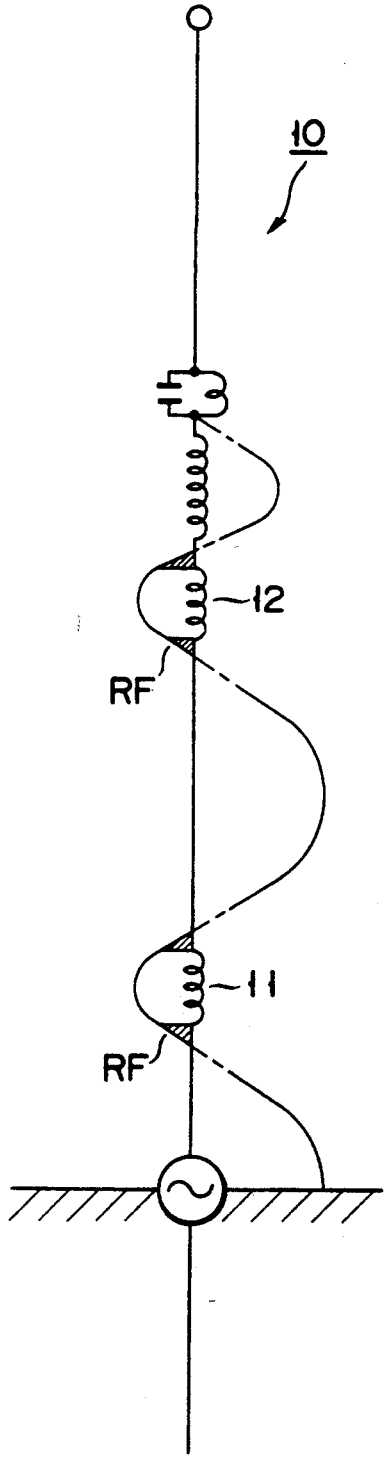

Therefore, as shown in FIG. 5, the cancellation of the negative phase (reverse phase) RF due to the first and second phasing coils 11 and 12 can not be completely performed. By the operation of the residual reverse phase RF, the half angle in the vertical surface pattern is expanded. As a result, the sensitivity of the transmission/reception of MT wave is little lowered even if an antenna can be fixed to a car body to be slightly inclined backward (for example, about 10° to 20°). Additionally, the gain is slightly lowered since the antenna is inclined. However, the the lowered gain can be sufficiently covered by the use of the three-step collinear system. According to the result of the experiment, in the two-step collinear ratio, the gain was slightly increased.

For the above reason, the antenna can be fixed to the car body to be inclined backward in a state wherein the antenna characteristic is not deteriorated and a favorable design is kept, and aerodynamic noise can be reduced.

Structurally speaking, the above-mentioned element is the same as a telescope-type element in that pipes having five different diameters are connected to each other. According to this, the maximum diameter of the antenna element is the same as the ordinary antenna for the AM and FM waves. Therefore, the antenna can be fixed to the car body without providing any special treatments in the antenna hole having a standardized diameter formed on the wall of the car body. Moreover, since the electrical length of the conductive mast, which is the auxiliary element 10C for the AM and FM waves and which determines the portion (so-called an under head size) where the antenna is contained in the car body, is set close to $(\frac{3}{8})\lambda$, the under head size can be contained within the range of the standardized size. As a result, the antenna element can be contracted and contained in even a relatively small car body without any troubles.

The present invention is not limited to the above embodiment. For example, in order that only the lower portion other than the trap element 10B and the auxiliary element 10C for AM and FM waves can be singly used, the above two portions may be separably structured. Moreover, it is possible to provide a low impedance converter in an antenna input circuit. Moreover, the electrical length of the conductive mast, which is the auxiliary element 10C for the AM and FM waves may be set to $(5/4)\lambda$, depending on the condition of use.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A three-wave shared antenna for use in an automobile wherein the three-wave shared antenna can transmit/receive a radio mobile telephone wave (an "MT wave") in a radio telephone band, and can receive radio broadcast waves, comprising:

a three-step, collinear MT wave element having first and second phasing coils located a predetermined distance apart from each other in an intermediate position along the MT wave element;

a trap element having means for interrupting the MT wave, said trap element being at a top portion of the MT wave element; and an auxiliary element for AM and FM radio waves, said auxiliary element including a conductive mast coupled to said MT wave element through said trap element so as to receive AM and FM radio waves in cooperation with said MT wave element;

wherein, for a wavelength λ of an electrical wave of a given frequency which is near a frequency of the transmission side in said radio telephone band, said MT wave element comprises:

a first element projecting through a wall of a car body and includes a first conductive mast portion whose electrical length is $\frac{3}{8}\lambda$, a second element formed on a top portion of said first element and includes a first phasing coil whose electrical length is $\frac{1}{4}\lambda$, a third element formed on a top portion of said second element and includes a second conductive mast portion whose electrical length is $\frac{3}{4}\lambda$, a fourth element formed on a top portion of said third element and comprising a second phasing coil whose electrical length is $\frac{1}{4}\lambda$, and a fifth element formed on a top portion of said fourth element and comprising a helical coil whose electrical length is $\frac{5}{8}\lambda$ to $\mu\lambda$.

2. A three-wave shared antenna according to claim 1, wherein:

said second conductive mast portion of the third element is a telescoping element including a plurality of conductive pipes having different diameters and slidably connected to each other, a conductive pipe of the largest diameter which is included in said second conductive mast portion being coupled to the top portion of said second element;

said fourth and fifth elements and a sixth element are integrally formed by winding an electrically conductive wire around an outer circumferential surface of a cylindrical insulating material with a different pitch, respectively, in accordance with a function of said fourth, fifth and sixth elements and which are detachably inserted through the third element into the first and second elements; and said auxiliary element for AM and FM radio waves is detachably inserted into said cylindrical insulating material.

* * * * *